United States Patent [19]

Hayes

[11] Patent Number: 4,919,982

[45] Date of Patent: Apr. 24, 1990

[54] THREE DIMENSIONAL TOY STRUCTURE

[76] Inventor: George K. C. Hayes, 2308 Schader Dr. #218, Santa Monica, Calif. 90404

[21] Appl. No.: 351,089

[22] Filed: May 12, 1989

[51] Int. Cl.[5] ..... B65D 5/00

[52] U.S. Cl. ..... 428/34.2; 428/80; 428/542.8; 446/478; 446/488

[58] Field of Search ..... 428/9, 34.2, 80, 542.8; 446/478, 488

[56] References Cited

U.S. PATENT DOCUMENTS

| | | | |
|---|---|---|---|
| 490,680 | 1/1893 | Roberts | 428/542.8 X |
| 781,082 | 1/1905 | Morris | 428/542.8 X |
| 1,092,321 | 4/1914 | Wiplitzhauser | 446/488 |
| 2,107,946 | 2/1938 | Inman | 428/542.8 X |
| 2,232,953 | 2/1941 | Mallgraf | 446/488 X |
| 3,207,357 | 9/1965 | Schmitt | 428/542.8 X |
| 3,785,066 | 1/1974 | Tuitt | 428/542.8 X |
| 4,319,418 | 3/1982 | Transport | 428/9 X |

FOREIGN PATENT DOCUMENTS

| | | | |
|---|---|---|---|
| 2126113 | 3/1984 | United Kingdom | 446/488 |

*Primary Examiner*—Henry F. Epstein

*Attorney, Agent, or Firm*—Fulwider Patton Lee & Utecht

[57] ABSTRACT

A foldable structure having an ornamental design resembling a spaceship is folded from a single blank and is large enough to permit a child to play inside. The single blank has numerous cutouts at specific angles, and has score and reverse lines at specific angles, to enhance the strength of the overall structure after it is completely folded into its spaceship configuration.

11 Claims, 5 Drawing Sheets

THREE DIMENSIONAL TOY STRUCTURE

BACKGROUND OF THE INVENTION

The invention relates generally to a single blank of cardboard that, once folded into a three dimensional form, resembles a spaceship in which a child can play.

As is known, children's toys, especially those made of cardboard or similar substances, must be able to withstand substantial wear and tear and abuse. Many toys that are made out of cardboard do not withstand the rigors encountered when children are playing energetically. Conventionally designed toys made from cardboard, in order to be durable, typically would have to be designed such that their costs would be exorbitant. These disadvantages are obviated by the present invention.

It is an object of the present invention to provide a toy resembling a spaceship that is large enough for children to play in, that is sturdy and durable, and can more easily withstand the abuse normally encountered when children play with their toys.

It is also an object of the invention to provide a cardboard toy that is easily assembled by small children and can be readily unfolded as herein described into a flat, easily stored unit.

It is a further object of the invention to provide a child's toy from a single blank of cardboard wherein various panels are folded and glued together to substantially increase the strength of several key portions of the container when assembled.

It is a still further object of the invention to provide a neatly packaged, flat container, which can be easily folded to provide a three-dimensional spaceship toy in which children can play.

It is another object of the invention to provide sloped door and front panels to add vertical strength to the structure when hinged and glued as designed and to resist external compressive forces.

It is also an object of the invention to provide a foldable container wherein the panels, once folded, have increased strength due to the crosshatch arrangement of the flutes in the cardboard.

In summary, the invention relates to a foldable structure made from a single blank of cardboard or a similar substance, and folded in the form of a spaceship in which children can play. The rear panel has foldable flaps along score lines, and reverse score lines, such that when the flaps are folded and glued to the rear panel, the flutes of the various flaps and panels form a crosshatch structure. The crosshatching of the flutes substantially increases the strength of the rear panel which is likely to receive substantial wear and tear by children playing with it. The bottom panel has a pair of flaps which are folded onto and glued to the bottom panel to increase its strength. Further, when the flaps are folded onto the bottom panel, a pair of triangular support columns are incorporated into the length of the bottom panel to further strengthen and add support to the bottom panel. The front panel has a pair of side panels which serve as doors for entering and exiting the structure. A latching means is provided to securely latch the rear and front panels at their top edges so that the structure, when completely folded, is in the form of a spaceship. The enclosure can be broken down such that it is flat and can be easily stored.

DETAILED DESCRIPTION OF THE INVENTION

Figure 1:
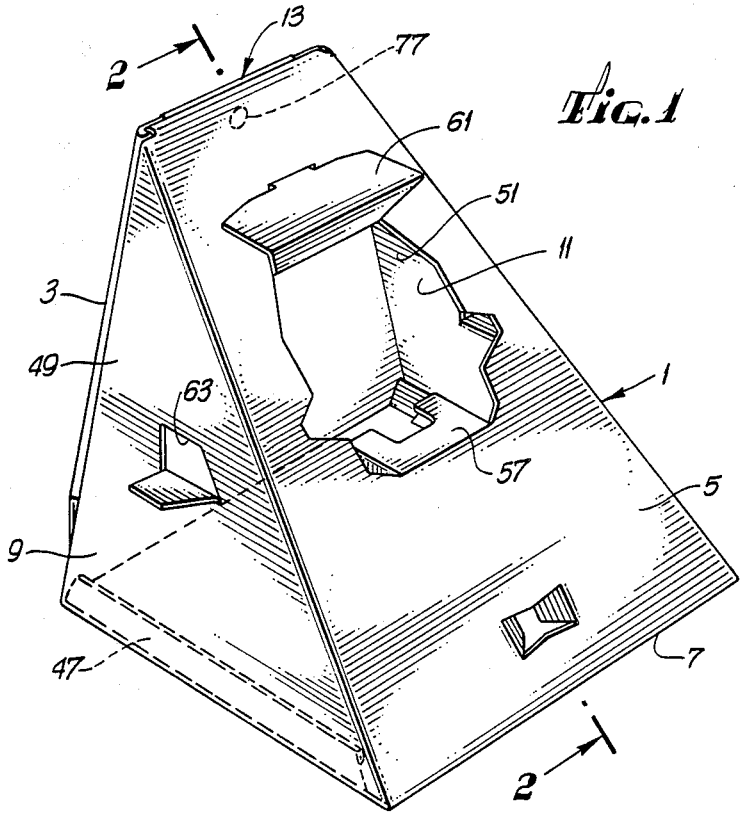
FIG. 1 is a front perspective view of a foldable structure having an ornamental design resembling a spaceship in which children play.

The preferred embodiment of the invention is depicted in FIG. 1 in its folded form and with an ornamental design as a spaceship. The spaceship is intended to be an ornamental structure for children to play in and is thus designed for durability and substantial wear-and-tear.

It is intended that the structure be folded and glued (as herein described) by the manufacturer and then shipped and packaged as a flat unit. It is, however, possible to provide the structure without any manufacture assembly so that the assembly would be left to the consumer. The structure is easily folded into its three dimensional shape, and unfolded for storage as a flattened unit.

Figure 2:
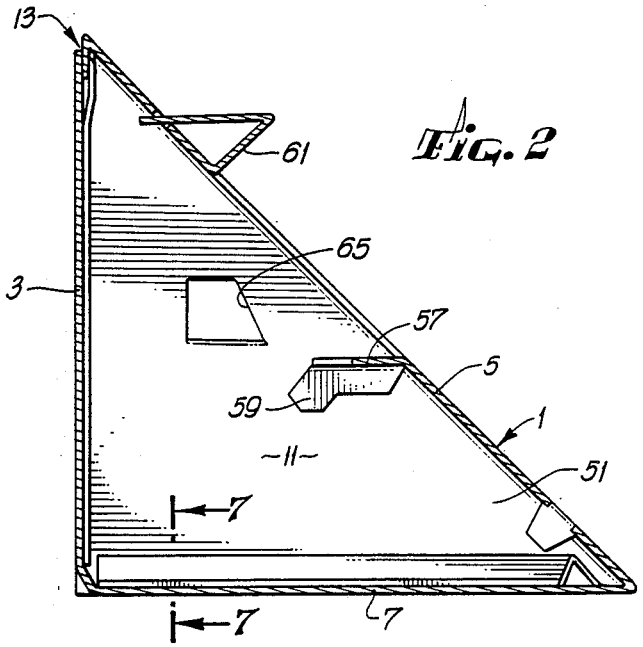
FIG. 2 is a cross-sectional view of the structure taken along line 2—2 depicting three thicknesses of cardboard in the rear panel and two thicknesses in the bottom panel.

As is shown in FIGS. 1 and 2, the spaceship comprises a single blank 1, preferably made of cardboard, which is folded by the consumer to form the depicted structure. The outer enclosure includes rear panel 3, and front panel 5, both of which are integral with bottom panel 7. A pair of side panels 9, 11 extend from front panel 5 and are foldable along score lines to form the spaceship enclosure. As shown in FIG. 2 and described more fully below, a latching means 13 is provided to secure the top edges of the rear and front panels for easy assembly and disassembly.

Figure 3:
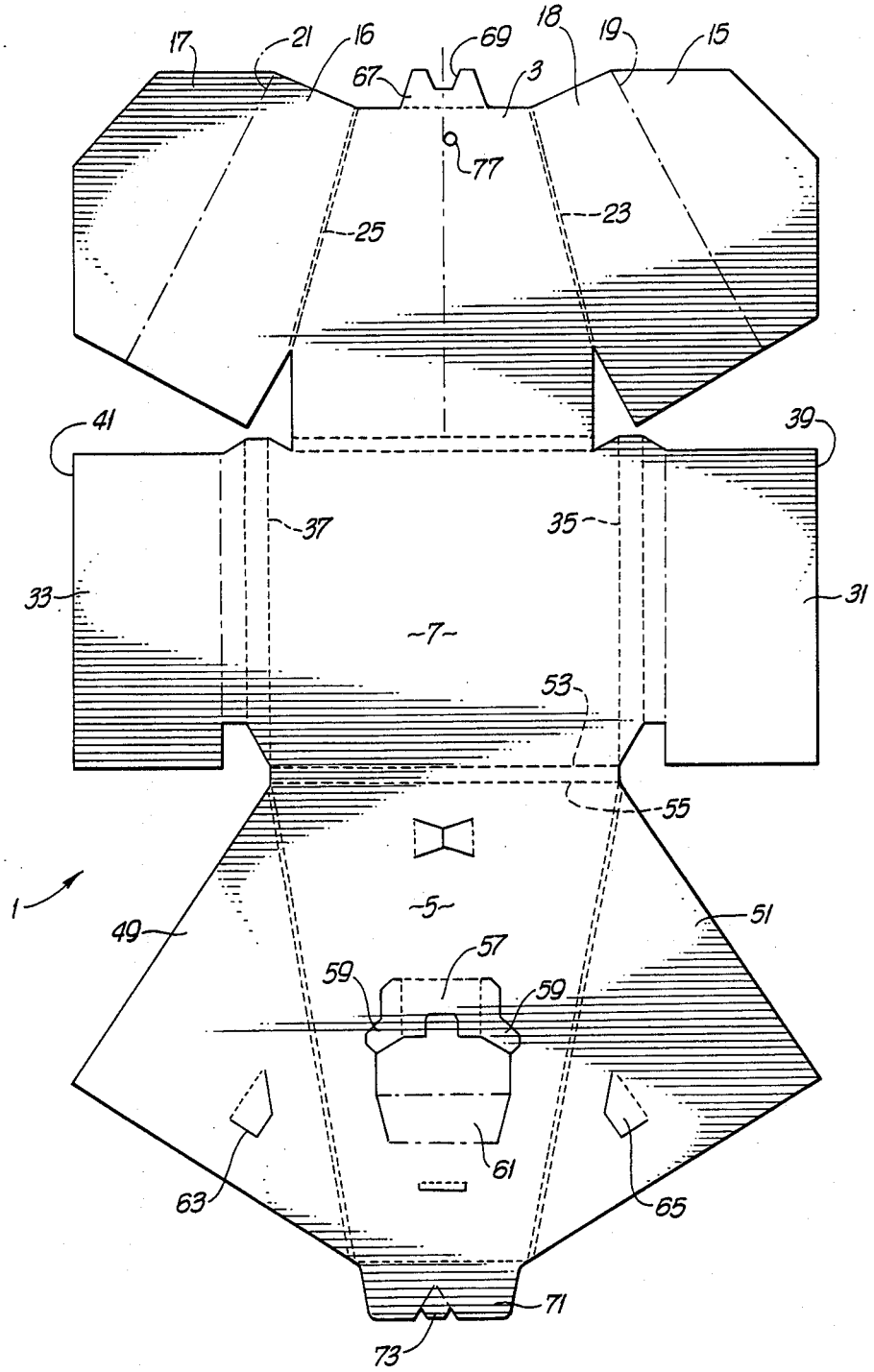
FIG. 3 is a plan view of a single blank depicting a plurality of score and reverse score lines.

Turning to FIG. 3, there is shown single blank 1, completely unfolded, and having a plurality of score and reverse score lines which define fold lines to form the various panels and flaps of the structure. The single blank 1 is a unitary piece of cardboard which can have various overall dimensions as long as the panels and flaps herein described mate and form the described structure. At present, blank cutting machines conveniently can provide cardboard blanks having specific lengths and widths. Further, the length of a blank may be limited by shipping methods. Thus, the present invention includes blank 1 having an overall length of less than 107 inches and overall width of less than 63 inches, which represents the maximum dimensions available with present technology. A blank starting out with these overall dimensions can be folded such that it forms the structure of FIG. 1 and still incorporates substantial strength enhancing features which are described below.

The dimensions of the invention are not to be limited by the present technology and it is intended that as technological advances occur, larger blanks can be formed. The preferred embodiment is to make the blank of corrugated cardboard, however, other substances may be suitable and the invention is not to be limited by the material or composition of the structure. Changes in dimensions and composition are envisioned and do not depart from the spirit and scope of the invention. As is known, corrugated cardboard is comprised of flutes which are channels formed by the undulating inner layer.

Figure 4:
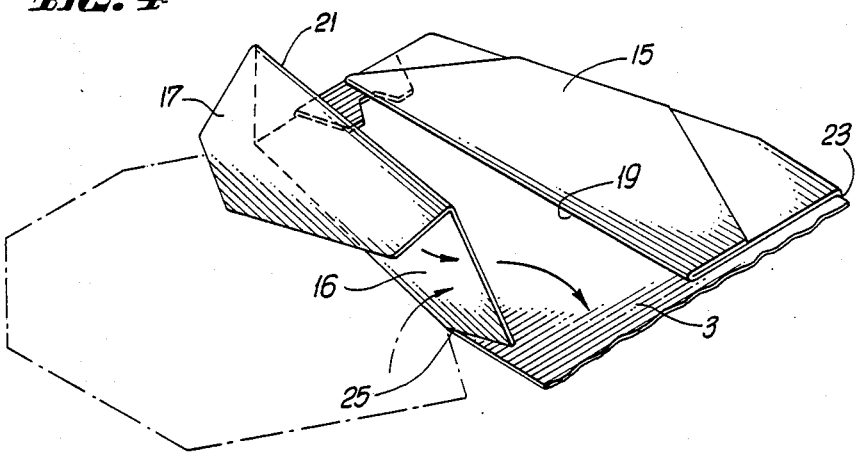
FIG. 4 is a partial perspective view taken of the rear panel and further depicting the foldable flaps as they are folded onto the panel.

As seen in FIGS. 3 and 4, rear panel 3 is shown as a single piece of cardboard integral with single blank 1 and having a pair of second foldable flaps, 15, 16, 17 and 18 extending on either side. Second foldable flaps 15, 16, 17 and 18 are folded along score, and reverse score lines such that edges 19, 21, when folded, abut at the longitudinal center line of rear panel 3. Thus, as shown in FIG. 4, flaps 16, 18 are folded once along score lines 23, 25 and also at edges 19, 21, which are reverse score lines. The net result of folding second foldable flaps 15, 16, 17 and 18 onto rear panel 3 is that the panel now has three thicknesses of cardboard instead of just one. Shown in phantom lines in FIG. 4 is second foldable flap 16 after it has been partially folded onto rear panel 3. Second foldable flaps 15, 18 are shown in their completely folded position on rear panel 3.

It is intended, for ease of packaging and to increase the overall strength of the cardboard structure, that second foldable flaps, 15, 16, 17 and 18 be permanently fixed to rear panel 3. The flaps can be fixed by any conventional means such as gluing, with staples, or other known means of fastening two surfaces together.

Figure 5:
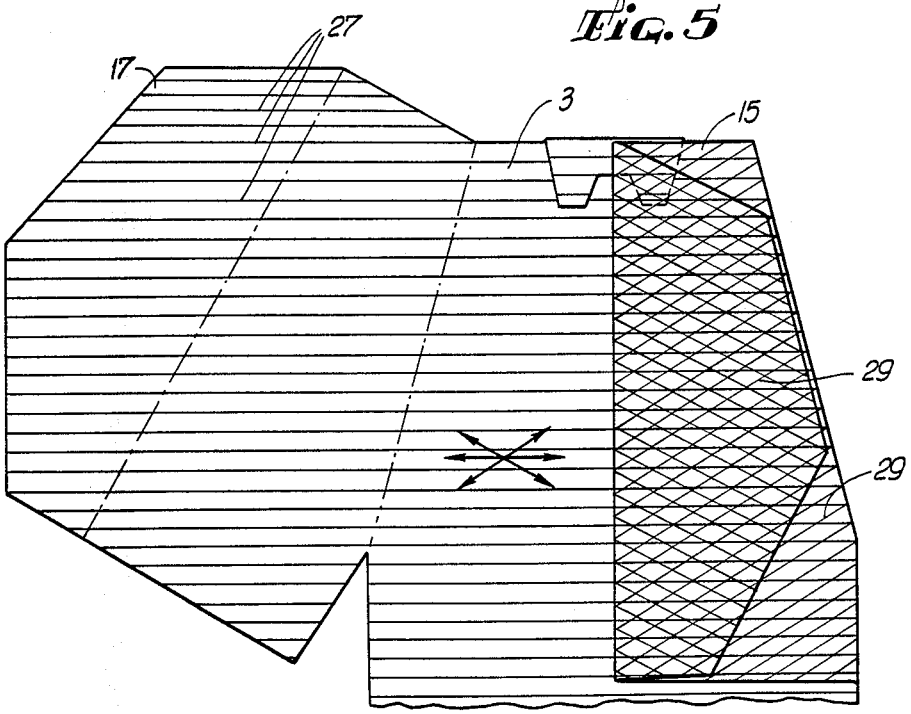
FIG. 5 is a partial sectional view of the rear panel depicting the flutes in the cardboard as they appear in a crosshatched pattern after the flaps are folded.

An important feature of the invention to increase the overall strength of the structure is depicted in FIG. 5 which shows the flutes 27 of the cardboard as they appear in rear panel 3 and flaps 15, 17. As can be appreciated, if flaps 15, 16, 17 and 18 were folded such that the flutes of rear panel 3 were parallel to the flutes of flaps 15, 16, 17 and 18 after folding, the structure, even though it would be three thicknesses, would have an inherent structural weakness due to the flutes all having a parallel relationship. However, the strength of the structure is vastly increased when foldable flaps 15, 16, 17 and 18 are cut at angles, and score and reverse score lines are at specific angles so that when the flaps are folded onto rear panel 3, the crosshatching 29 of the flutes 27 occurs. It is readily apparent that such crosshatching 29 of flutes 27 substantially increases the strength of the rear panel in all directions in addition to the three thicknesses of corrugated cardboard that make up the rear panel after folding.

Figure 6:
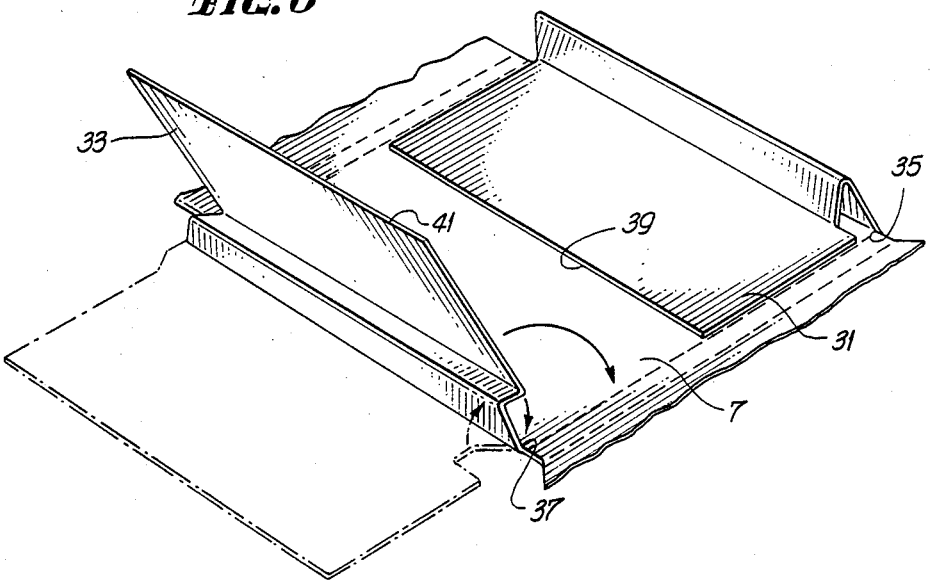
FIG. 6 is a partial perspective view of the bottom panel and its associated flaps as they are being folded.

As is shown in FIG. 6, a sectional view of bottom panel 7 is depicted in a partially folded condition. Bottom panel 7 comprises a pair of first foldable flaps, 31, 33 that are folded along score lines 35, 37 and onto bottom panel 7. First foldable flaps 31, 33 are cut such that when folded onto bottom panel 7 their edges 39, 41 are intended to abut at the center of the panel. It is intended that first foldable flaps 31, 33 be permanently fixed to bottom panel 7 by conventional means as described above.

Figure 7:
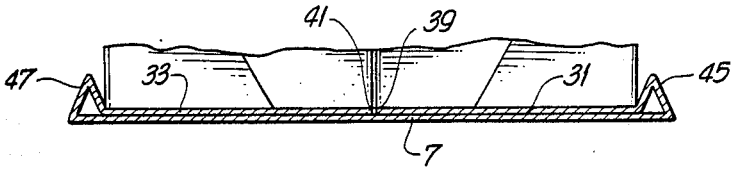
FIG. 7 is a partial cross-sectional view taken along line 7—7 depicting triangular support columns in the bottom panel.

As shown in FIG. 7, with first foldable flaps 31, 33 folded onto panel 7, the thickness of the bottom of the structure is doubled, thereby increasing its overall strength. Also shown in FIG. 7, is another important feature of the invention which occurs as a result of how first foldable flaps, 31, 33 are folded onto the bottom panel. When first foldable flaps 31, 33 are folded, they are folded such that longitudinal triangular supports 45, 47 are formed along the longitudinal edges of bottom panel 7. As is clear, when a child is playing inside the structure, he or she will be sitting on flaps 31, 33 and entering and leaving the structure over the top of triangular supports 45, 47. Thus, supports 45, 47 provide added strength to bottom panel 7 in the longitudinal direction, as well as providing protection to the bottom panel as children enter and leave the spaceship.

Figure 9:
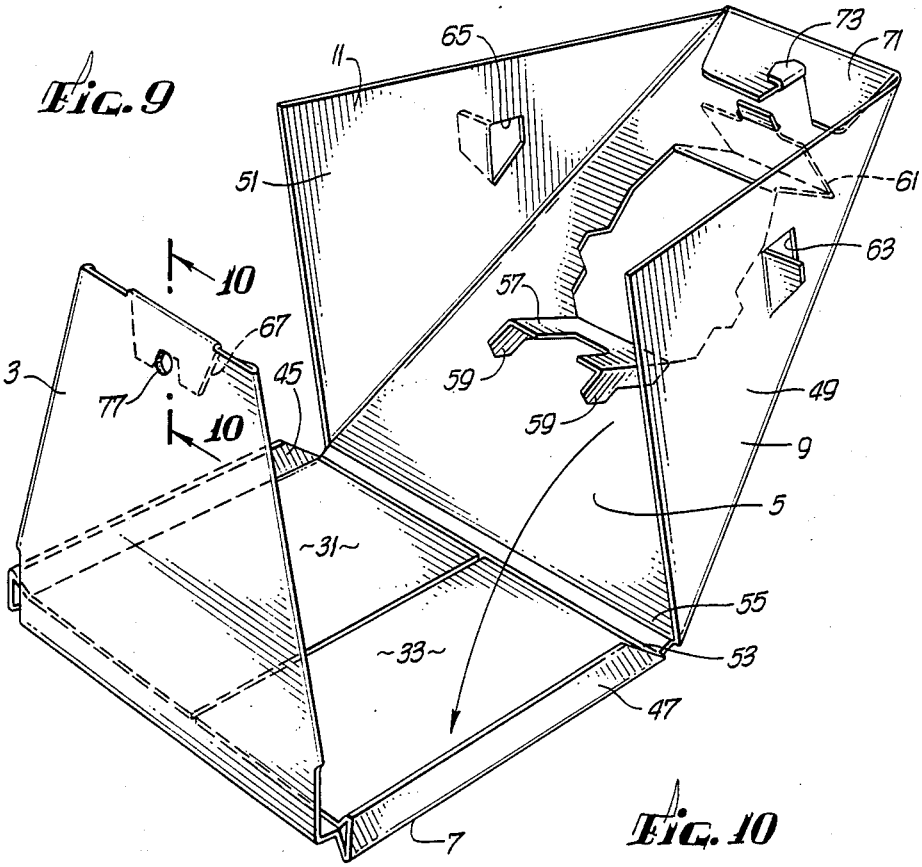
FIG. 9 is a partial perspective view depicting the front panel.

In FIG. 9, front panel 5 is depicted with a pair of side panels 49, 51 which are intended to form doors for entering and exiting the spaceship structure. Front panel 5 is foldable along score lines 53, 55 so that it can be bent approximately 135° from its flattened position to come in contact with rear panel 3 which is folded upward to approximately a 90° position.

Front panel 5 has several cutouts that form structural features inside and outside of the spaceship for children to play with and hold on to while playing inside the spaceship. One such cutout is control panel 57 which is folded inwardly and has a pair of handles 59 for a child to hold on to. Control panel 57 will have an ornamental design depicting a spaceship control panel. A visor 61 is folded to the outside and above control panel 57 and locked into place by a tab and slot arrangement. Window cutouts 63, 65 are provided in side panels 49, 51 so that a child can see out of the spaceship from side to side.

Figure 10:
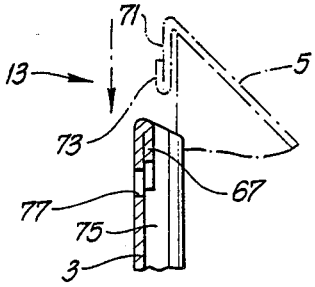
FIG. 10 is a partial cross-sectional view taken along line 10—10 of the latch assembly before the latch from the front panel (phantom) is inserted into the slot of the rear panel.
Figure 11:
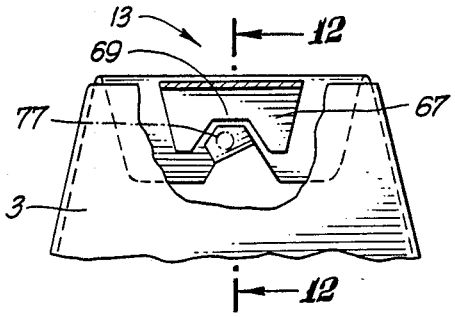
FIG. 11 is a partial cross-sectional view of the latch assembly in its fully latched position.
Figure 12:
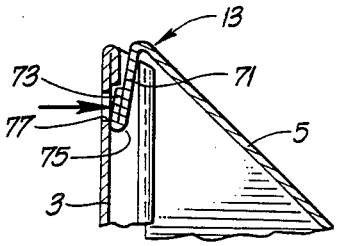
FIG. 12 is a partial cross-sectional view of the latch assembly showing the interlocking relationship of the latch and slot.

Another feature of the invention is to provide a latch means 13 for latching rear panel 3 and front panel 5 at their upper edges after the structure is completely folded. As is shown in FIGS. 10–12, latch means 13 comprises a first tab 67 that is integral with rear panel 3, and is folded and fixed permanently onto the panel by known means. First tab 67 has a recessed portion 69 for receiving the latch. Front panel 5 has second tab 71 that is foldable, but not fixed to panel 5. Second tab 71 has a latch 73 that matingly engages recessed portion 69 when second tab 71 is inserted into rear panel 3. It is noted that latch 73 is folded onto tab 71 and fixed thereto by known means such as gluing. A slot 75 is formed when flaps 16 and 18 are folded onto and fixed to rear panel 3. Thus, second tab 71 slides into slot 75 a distance such that latch 73 matingly engages recessed portion 69 to securely latch the upper edges of the front and rear panels.

It is intended that the spaceship structure be capable of being folded flat for easy storage. Thus, to unlatch the front and rear panels, a hole 77 is provided in rear panel 3 so that when one sticks their finger through the hole and pressing latch 73, it will force latch 73 out of engagement with recessed portion 69, thereby freeing second tab from slot 75 to unlatch the structure.

Figure 8:
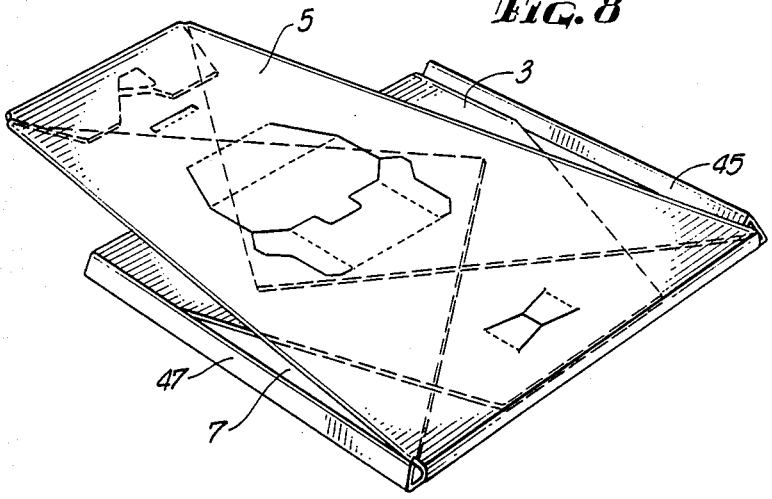
FIG. 8 is a perspective view of the enclosure in its unfolded, flat configuration which permits easy storage.

As seen in FIG. 8, after the unlatching sequence is completed, rear panel 3 is folded onto bottom panel 7 and the side panels 49, 51 are folded inwardly, while front panel 5 is folded onto the entire structure. After unfolding the structure so that it is flat, it will be on the order of several inches thick for easy storage. The spaceship can be easily folded into its assembled form by a young child due to its unique design.

References to score and reverse score lines are intended to mean slight indentations intentionally incorporated into the cardboard to facilitate folding. A score line is continuous and is formed by a die stamp that slightly crushes the cardboard to make an indentation, but not deep enough to break the surface of the cardboard. Reverse score lines consist of alternating score lines and cuts so that a particular panel or flap may be folded in either direction with ease or folded back onto itself. Score and reverse score lines are all made on one side of the blank to facilitate folding and reduce the costs of manufacturing. To turn a blank over to add score lines to the back of the blank would substantially increase the cost of manufacture, thus reverse score lines are an important aspect of the invention.

What is claimed is:

1. A foldable structure in which children play comprising:
   (a) a single blank having a plurality of score and reverse score lines for folding therealong to define foldable flaps,
   (b) a bottom panel having a single thickness with first foldable flaps along score lines on either side such that when said flaps are folded onto said bottom panel they double the thickness of said panel,
   (c) a rear panel having a single thickness with second foldable flaps along score and reverse score lines such that when said second flaps are folded onto said rear panel it will treble the thickness of said rear panel,
   (d) a first tab extending from and foldable onto said rear panel to form a slot therein,
   (e) a front panel having a pair of side panels extending therefrom and foldable along score lines,
   (f) a second tab extending from one end of said front panel and foldable along score lines,
   (g) means for latching together the top edges of the front and rear panels by inserting said second tab into said slot,
   (h) said single blank having an ornamental design such that when said front and rear panels are latched together, said side panels are folded to form a structure for a child to play inside.

2. The foldable structure of claim 1 wherein said latching means further comprises a recess in said first tab for matingly receiving a latch in said second tab so that when said second tab is inserted into said slot, said latch comes into an interlocking relationship with said recess.

3. The foldable structure of claim 1 wherein said latching means further comprises an opening in said rear panel to insert one's finger to release said latching means when breaking down said container into flat panels.

4. The foldable structure of claim 1 wherein said rear panel and second foldable flaps further comprise a plurality of longitudinal flutes, said second foldable flaps being folded onto and fixed to said rear panel such that the flutes form a cross-hatching pattern to strengthen said rear panel.

5. The foldable structure of claim 1 wherein said front panel further comprises a foldable control panel and a foldable visor that folds along score lines and when folded forms ornamental parts for a child to play with while inside said structure.

6. The foldable structure of claim 1 wherein said side panels each have at least one foldable section that folds along score lines and when folded, forms a window.

7. The foldable structure of claim 1 wherein said bottom panel further comprises a plurality of score and reverse score lines so that as said second foldable flaps are folded onto and fixed to said bottom panel, a pair of triangular support columns are formed in said bottom panel to add strength to said panel to that section of the panel where children will enter and exit the structure.

8. The foldable structure of claim 1 wherein said single blank has an overall length of less than 107 inches and overall width of less than 63 inches.

9. The foldable structure of claim 1 wherein said front and rear panels are substantially trapezoidal, said bottom panel is rectangular, and side panels are triangular so that when folded and latched the structure represents a spaceship in which children play.

10. A foldable structure in which children play comprising:
   (a) a single blank having a plurality of score and reverse score lines for folding therealong to define foldable flaps,
   (b) a bottom panel having a single thickness with first foldable flaps along score lines such that when said flaps are folded onto and fixed to said bottom panel they double the thickness of said panel,
   (c) a rear panel having a single thickness with second foldable flaps along score and reverse score lines such that when said second flaps are folded onto and fixed to said rear panel it will treble the thickness of said panel,
   (d) a plurality of flutes in said rear panel and second foldable flaps, said flutes forming a crosshatch pattern when said second flaps are folded and fixed onto said rear panel,
   (e) a front panel having a pair of side panels extending therefrom and foldable along score lines,
   (f) means for latching together the top edges of said front and rear panels
   (g) said single blank having an ornamental design so that when front and rear panels are latched together, said side panels are folded to form a three dimensional structure for a child to play inside.

11. A foldable structure in which children play comprising:
   (a) a single blank having a plurality of score and reverse score lines for folding therealong to define foldable flaps,
   (b) a bottom panel having a single thickness with first foldable flaps along score lines on either side such that when said flaps are folded onto said bottom panel, it doubles the thickness of said bottom panel,
   (c) a rear panel having a single thickness with second foldable flaps with score and reverse score lines such that when such second flaps are folded onto said rear panel, it will treble the thickness of said rear panel,
   (d) a plurality of flutes in said rear panel and second foldable flaps, said flutes forming a crosshatch pattern when said second flaps are folded and fixed to said rear panel, (e) a front panel having a pair of side panels extending therefrom and foldable along score lines, (f) means for latching together the top edges of said front and rear panels, (g) said single blank having an ornamental design of a spaceship so that when said front and rear panels are latched together, said side panels are folded to form a structure in which a child can play.

* * * * *